United States Patent [19]

Tkach et al.

[11] 4,325,848

[45] Apr. 20, 1982

[54] CELLULOSE-BASED ELECTRIC INSULATION MATERIAL CONTAINING BORIC ANHYDRIDE AND PROCESS FOR PRODUCING SAME

[76] Inventors: Lev N. Tkach, ulitsa Griboedova, 8; Jury N. Prikhodko, ulitsa Klubnaya, 12a, both of Malin Zhitomirskoi oblasti; Leonid M. Vaisman, ulitsa Entuziastov, 47, kv. 37, Kiev; Vladimir I. Soldatenko, ulitsa Klubnaya, 12; Vasily V. Kostjuchenko, ulitsa Klubnaya, 2, kv. 5, both of Malin Zhitomirskoi oblasti, all of U.S.S.R.

[21] Appl. No.: 171,926

[22] Filed: Jul. 24, 1980

Related U.S. Application Data

[63] Continuation of Ser. No. 28,305, Apr. 9, 1979, abandoned.

[30] Foreign Application Priority Data

Oct. 26, 1978 [SU] U.S.S.R. ..... 2674052
Oct. 26, 1978 [SU] U.S.S.R. ..... 2674053

[51] Int. Cl.[3] ..... D21C 3/04; D21H 3/68; H01B 3/52

[52] U.S. Cl. ..... 252/567; 162/138; 162/158; 162/181 R; 162/181 A; 162/181 B

[58] Field of Search ..... 252/567; 162/138, 181 R, 162/181 A, 181 B, 158

[56] References Cited

U.S. PATENT DOCUMENTS

| | | | |
|---|---|---|---|
| 1,860,134 | 5/1932 | Brown | 162/181 B |
| 3,316,178 | 4/1967 | Millington | 162/138 X |
| 3,419,498 | 12/1968 | Palumbo et al. | 162/138 X |
| 4,130,458 | 12/1978 | Moore et al. | 162/181 A |

FOREIGN PATENT DOCUMENTS

| | | | |
|---|---|---|---|
| 303390 | 7/1971 | U.S.S.R. | 162/138 |
| 444851 | 11/1974 | U.S.S.R. | 162/181 |
| 536275 | 3/1977 | U.S.S.R. | 162/138 |

*Primary Examiner*—P. E. Willis, Jr.
*Attorney, Agent, or Firm*—Ladas & Parry

[57] ABSTRACT

The present invention relates to a cellulose-based electric insulation material and to a process for producing thereof.

The cellulose-based electric insulation material contains from 0.02 to 1.1 weight % of boron with respect to absolutely dry material. The process for preparing said cellulose-based electric insulation material resides in that a cellulose-based paper pulp is prepared and cast for sheet making, the obtained paper sheets being pressed and dried. One of said intermediate products, namely paper pulp or paper sheets is treated with a chemical reagent which is boric acid or a boron compound forming boric acid when reacting with water or mixtures thereof, said chemical reagents being taken in amounts ensuring the boron content in the end product from 0.2 to 1.1 weight % with respect to absolutely dry material.

8 Claims, No Drawings

CELLULOSE-BASED ELECTRIC INSULATION MATERIAL CONTAINING BORIC ANHYDRIDE AND PROCESS FOR PRODUCING SAME

This is a continuation of application Ser. No. 028,305 filed Apr. 9, 1979, now abandoned.

FIELD OF APPLICATION OF THE INVENTION

The present invention relates to electric insulation materials and processes for producing thereof, and more particularly to a collulose-based electric insalation material and to a process of producing thereof.

There is an ever growing demand for usuch materials (electric insulation paper and cardboard) in spite of the fact that more and more electric insulation materials based on synthetic polymers, ceramics, etc find wide application.

Nevertheless, as far as the main dielectric properties and prolonged stability in a wide range of operating temperatures are concerned, cellulose-based electric insulation materials do not meet growing requirements imposed on their quality by the electrical and radio engineering industries.

One of the main dielectric properties are dielectric power losses in insulators operating in alternating current curcuits as, for example, intermediate layer in paper capacitors or cable windings. Qualitatively these losses are evaluated by dielectric loss tangent denoted further as tan δ. The smaller this parameter, the lesser part of electric energy is consumed for heat losses and the more reliable and long-lived is an article in which an electric insulation material is used.

Another important property of electric insulation materials is their resistivity measured usually in Ohm.cm.

The above-mentioned dielectric properties affect the third important parameter, namely, electric strength. This effect is the stronger, the less stable are tan δ and resistivity within the operating temperature range and the more pronounced is their change during operation. Thus, for example, it has been shown that an increase in tan δ due to cellulose ageing leads to a temperature rise inside the condenser which, in its turn, accelerates cellulose ageing and causes a further increase of tan δ and temperature until a thermal break-down takes place and the condenser or cable fail to operate. A decrease of resistivity due to a rise in operating temperature because of some other reasons.

BACKGROUND OF THE INVENTION

Known in the art are some electric insulation materials based on cellulose and processes for producing thereof aimed at improving stabilization of tan δ and resistivity. Known processes comprise the stages of paper pulp preparation, sheet-making, pressing, and drying. A decrease in ionic dielectric losses is attained by introducing of chemical reagents into a paper pulp, (for instance, zinc salts (Inventor's Certificate of the USSR No. 540,003) and magnesium salts (Inventor's Certificate of the USSR No. 300562).

However, a decrease in tan δ of electric insulation material is observed only at elevated temperatures (80°-140° C.) and is very small at lowered temperature (30°-80° C.).

Also known in the art is electric insulation material based on a modified cellulose and process for preparing thereof.

As a modified cellulose use is made of borylated cellulose obtained by treating cellulose with a melt of a boric acid mixture with urea or borax at 180°-260° C. with subsequent water-washing of an unreacted boric acid (Inventor's Certificate of the USSR Nos. 303390 and 536275). The electric insulation material obtained by known method has decreased dipole dielectric losses, whereas ionic dielectric losses remain unchanged. In addition, this method is technologically complicated and does not find practical application.

BRIEF DESCRIPTION OF THE INVENTION

It is an object of the invention to eliminate the above-cited disadvantages.

The principal object of the invention is, by selecting a new chemical reagent for treating paper pulp or paper sheet, to provide a cellulose-based electric insulation material which will improve the values of tan δ and electric resistivity.

The principal object of the invention is to decrease tan δ, increase electric resistivity of cellulose-based electric insulation materials and to stabilized said parameters during operation.

Said principal object is accomplished by the provision of a cellulose-based electric insulation material containing from 0.02 to 1.1 weight % of boron with respect to absolutely dry material.

The process for preparing a cellulose-based electric insulation material comprises the stages of cellulose-based paper pulp preparation, sheet-making, pressing, treating with a chemical reagent, drying, and preparation of the final material; according to the invention, as a chemical reagent use is made of boric acid or a boron compound forming boric acid when reacting with water, said reagents being used either separately or in combination and taken in amounts ensuring the boron content in the final product of from 0.02 to 1.1 weight % with respect to absolutely dry material.

To simplify the treatment of paper pulp or paper sheet with a chemical reagent, it is expedient to use boric acid in the form of its aqueous or water-alcohol solution. The use of boric acid in the form of water-alcohol solution makes it possible to obtain paper with practically constant density without considerable deformation, which excludes subsequent shrinkage of the paper sheets on special equipment.

It is preferable to use as the boron compound forming boric acid when reacting with water, boric anhydride, metaboric acid, or triethylborate; it is expedient to use the boron compound in the form of its alcohol solution for a better treatment of paper pulp or paper sheets.

The compounds used as the chemical reagent, namely, boric acid or boron compounds forming boric acid when reacting with water, said reagents being used either separately or in combination, can be introduced both at the stage of paper pulp preparation and before the pressing or drying stage.

DETAILED DESCRIPTION OF THE INVENTION

The proposed process is accomplished in the following way.

Paper pulp containing wood or cotton cellulose as the main ingredient is prepared by one of the methods known in the art.

Already at the stage of paper pulp preparation, boric acid or such boron compounds as boric anhydride, metaboric acid, triethylborate, or mixtures thereof, can be introduced into the pulp. Boric acid dissolves in water entering the paper pulp composition, whereas boric anhydride, metaboric acid, or triethylborate react with water yielding boric acid solution. The amount of boric acid or one of the boron compounds, or the mixture thereof is calculated so as to ensure the boron content in the final product from 0.02 to 1.1 weight % with respect to absolutely dry material.

Boric acid and boron compounds can be used both in their crystalline state and in the form of solutions.

It is expedient to use boric acid as an aqueous or water-alcohol solution and the boron compound as an alcohol solution.

The paper pulp obtained is cast for sheet making by one of conventional processes; the sheet prepared is pressed and dried with the use of equipment commonly employed in paper-making plants. When electric insulation material with an increased density is required, the paper sheet is subjected to calendering.

The introduction of boric acid, the boron compound, or a mixture thereof is possible at other stages of the process which follow after paper pulp preparation and sheet making, namely, before pressing or drying.

The introduction of boric acid or boron compounds into paper pulp or sheets decreases not only ionic dielectric losses in electric insulation material but dipole dielectric losses as well and stabilize tan δ value of absolutely dry electric insulation material within a wide temperature range. Thus, for example, at 60°-120° C., when the boron content in electric insulation paper is 0.27-0.45 weight %, tan δ is practically constant.

With increasing boron contet in absolutely dry electric insulation material up to 1.1 weight %, tan δ at different temperatures changes only slightly.

Cellulose-based electric insulation materials obtained by the described process has the following technical parameters:

| | |
|---|---|
| thickness, mm | 5-500 |
| volume mass, g/cm$^3$ | 0.6-1.35 |
| boron content in weight % with respect to absolutely dry material | 0.02-1.1 |

tan δ of dry electric insulation paper made from electric insulation wood cellulose and having a density of 0.7 g/cm$^3$:

| Temperature °C. | For paper prepared with the use of deionized water | For paper prepared with the use of industrial water with conductivity about 250μ S/cm and containing about 0.5 mg-equiv/l of sodium salts |
|---|---|---|
| 30 | 0.00040 | 0.00040 |
| 60 | 0.00035 | 0.00035 |
| 100 | 0.00030 | 0.00040 |
| 120 | 0.00035 | 0.00050 |
| tan δ of dry paper prepared from electric insulation cellulose and having a density of 1.2 g/cm$^3$: | | |
| 60 | 0.0008 | 0.0008 |
| 100 | 0.0008 | 0.0010 |
| 120 | 0.0008 | 0.0013 |

For a better understanding of the present invention specific examples of realizing thereof are given hereinbelow by way of illustration which in no way limit the scope of the invention as it is to be understood by those skilled in the art.

EXAMPLE 1

Electric insulation paper is prepared under laboratory conditions on the basis of pure electric insulation cellulose obtained from tissue of conifers with the use of desalted water.

Paper pulp is prepared by breaking in a laboratory stirrer 10 g of electric insulation cellulose poured over with 0.1% of aqueous solution of boric acid during half of an hou at 1000 rpm, and by grinding the obtained suspension in a laboratory beater for 12 hours to 95° Schotter-Reigler.

The paper pulp is then diluted with 1000 ml of desalted water after which paper is manufactures on a laboratory installation by casting, pressing, and drying of the paper sheets. The paper prepared has a density of 0.7 g/cm$^3$, thickness 50μ, and contains 0.02 weight % of boron with respect to absolutely dry material.

The same material is used for preparing by the same process and on the same equipment but with the use of desalted water control samples of electric insulation paper, the density and thickness of which equal those of the paper containing boric acid.

The value of tan δ is determined for the samples of paper of both types in the following way.

Paper samples are collected into a pack 280-320μ thick. The pack is pressed between flat electrodes 46 mm in diameter under a pressure of 0.2 kgf/cm$^2$ and dried in vacuum under a residual pressure of $5.10^{-4}$ mm Hg at 125° C. for 2 hours. Then the packs are cooled in vacuum under the same residual pressure down to experimental temperature which is 30°,60°,100°, or 120° C. and thermostatted at one of these temperature value. After the electrodes are connected to the measuring arm of the Schering bridge, the tests are conducted with the use of industrial alternating current with a frequency of 50 Hz at a voltage of 5 V/μ. The tan δ values are being read directly off the Schering bridge after the latter has been balanced.

Table 1 presents the values of tan δ determined for the paper samples obtained according to the described process.

TABLE 1

| Temperature, °C. | tan δ of the samples: containing boron | tan δ of the samples: control |
|---|---|---|
| 30 | 0.00105 | 0.00105 |
| 60 | 0.00085 | 0.00085 |
| 100 | 0.00085 | 0.00085 |
| 120 | 0.0010 | 0.0012 |

EXAMPLE 2

Electric insulation paper is prepared under laboratory conditions on the basis of pure electric insulation cellulose obtained from fissue of conifers with the use of deionized water.

Paper pulp is prepared by breaking 10 g of electric insulation cellulose poured over with 1000 ml of 1.2% aqueous solution of boric acid in a laboratory stirrer for half an hour at 1000 rpm and by grinding the obtained suspension in a laboratory beater for 16 hours to 96° Schotter-Riegler.

The paper pulp is then diluted with 3000 ml of desalted water after which paper is manufactured on a laboratory installation by casting, pressing, and drying of the paper sheets. The paper prepared has a density of 0.7 g/cm$^3$, thickness 50$\mu$, and contains 0.11 weight % of boron with respect to absolutely dry material.

The control samples of electric insulation paper are obtained from the same material by the same process and on the same equipment but with the use of deionized water. The density and thickness of control paper equal those of the paper containing boric acid.

The value of tan $\delta$ is determined for the samples of paper of both types by following the procedure described in Example 1.

The determined values of tan $\delta$ are given in Table 2.

TABLE 2

| Temperature, °C. | tan $\delta$ of the samples containing boron | control |
|---|---|---|
| 30 | 0.0009 | 0.00105 |
| 60 | 0.0007 | 0.00085 |
| 100 | 0.0007 | 0.00090 |
| 120 | 0.0007 | 0.0012 |

EXAMPLE 3

Electric insulation paper is prepared under laboratory conditions on the basis of pure electric insulation cellulose obtained from fissue of conifers with the use of deionized water.

Paper pulp is obtained by breaking 10 g of electric insulation cellulose, poured over with 100 ml of 28% aqueous solution of boric acid and 900 ml of deionized water, in a laboratory stirrer for half an hour at 1000 rpm.

Dilution and preparation of paper samples as well as preparation of control samples of electric insulation paper not containing boron is performed by following the procedure described in Example 2. The thickness of the samples is 50$\mu$, density 0.7 g/cm$^3$, and boron content 0.25 weight % with respect to absolutely dry material.

The samples of the paper of both types are tested by following the procedure described in Example 1.

The determined values of tan $\delta$ are given in Table 3

TABLE 3

| Temperature, °C. | tan $\delta$ of the samples containing boron | control |
|---|---|---|
| 30 | 0.0006 | 0.00105 |
| 60 | 0.0005 | 0.00085 |
| 100 | 0.0005 | 0.00090 |
| 120 | 0.0005 | 0.0012 |

EXAMPLE 4

Electric insulation paper is prepared under laboratory conditions on the basis of pure electric insulation cellulose obtained from tissue of conifers with the use of deionized water.

For preparation of the laboratory paper samples use is made of the paper pulp containing 2% cellulose and manufactured under industrial conditions. 100 g of said paper pulp are ground in a laboratory breaker to 96.5° Schotter-Riegler. Then 30 g of boric acid are introduced into the pulp and the volume of the mixture is brought up to 1000 by adding deionized water. After stirring the diluted paper pulp for three minutes, the samples of electric insulation paper are prepared by casting, pressing, and drying paper sheets on a laboratory paper-making installation. The samples are 50$\mu$ thick, have a density of 0.7 g/cm$^3$ and contain 1.1 weight % of boron with respect to absolutely dry material.

Control samples of electric insulation paper not containing boron are obtained in a similar way but with the use of deionized water only. Tan $\delta$ is measured by following the procedure described in Example 1.

The values of tan $\delta$ determined for the paper samples are given in Table 4.

TABLE 4

| Temperature, °C., | tan $\delta$ of the samples containing boron | control |
|---|---|---|
| 30 | 0.00050 | 0.00105 |
| 60 | 0.00040 | 0.00085 |
| 100 | 0.00035 | 0.00090 |
| 120 | 0.00040 | 0.00120 |

EXAMPLE 5

The capacitor paper manufactured under industrial conditions with the use of deionized water at all stages of the process, said paper having a mass of 13 g per m$^2$, humidity 8%, density 0.8 g/cm$^3$, is wetted with 8% aqueous solution of boric acid up to a moisture content of 26%.

The wetted paper is calendered up to a density of 1.2 g/cm$^3$ and dried. Control samples are prepared from the same paper wetted with deionized water only.

The samples obtained are subjected to complex testing. Tan $\delta$ values are determined by following the procedure described in Example 1. Other technical parameters shown below are found by known procedures.

The parameters of experimental and control samples of electric insulation paper are given in Table 5.

TABLE 5

| Nos 1 | Parameter 2 | Samples containing boron 3 | control 4 |
|---|---|---|---|
| 1. | Thickness, $\mu$ | 10.6 | 10.4 |
| 2. | Density, g/cm$^3$ | 1.20 | 1.19 |
| 3. | Length of fracture, km | 9.6 | 9.7 |
| 4. | Specific conductivity of water extract $\mu$ S/cm at a modulus of 1:50 | 11 | 10 |
| 5. | pH of water extract | 6.8 | 7.0 |
| 6. | Breakdown voltage for one paper layer, V | 490 | 490 |
| 7. | Dielectric loss tangent for dry paper at temperature, °C. | | |
| | 30 | 0.0012 | 0.0020 |
| | 60 | 0.00095 | 0.00165 |
| | 100 | 0.00095 | 0.018 |
| | 120 | 0.0010 | 0.0023 |
| 8. | Resistivity of dry paper, Ohm, cm, at 120° C. | $3.9.10^{16}$ | $2.8.10^{15}$ |
| 9. | Dielectric constant | 2.9 | 3.1 |
| 10. | Dielectric loss tangent of the paper impregnated with trichlorophenyl (in small-size capacitors at temperature, °C. | | |
| | 20 | 0.0021 | 0.0035 |
| | 60 | 0.0018 | 0.0030 |
| | 100 | 0.0017 | 0.0032 |
| | 120 | 0.0020 | 0.0040 |
| 11. | Boron content with respect to absolutely dry material, weight % | 0.27 | 0 |

EXAMPLE 6

Capacitor paper manufactured under industrial conditions with the use at all stages of water with conductivity about 250μ S/cm, containing 0.5 mg-equiv/1 of sodium salts and having a density of 0.76 g/cm$^3$, is wetted with 8% aqueous solution of boric acid up to a moisture conten 25%, calendered to a density of 1.2 g/cm$^3$, and dried.

The same paper wetted only with industrial water is treated in a similar way and used for preparing control samples.

The samples obtained are subjected to complex testing the results of which are given in Table 6.

TABLE 6

| Nos 1 | Parameter 2 | Samples containing boron 3 | Samples control 4 |
|---|---|---|---|
| 1. | Thickness, μ | 8.2 | 8.2 |
| 2. | Density, g/cm$^3$ | 1.20 | 1.20 |
| 3. | Length of fracture, km | 9.7 | 9.5 |
| 4. | Specific conductivity of water extract, μS/cm, at a modulus of 1.50 | 33 | 26 |
| 5. | pH of water extract | 7.3 | 7.6 |
| 6. | Breakdown voltage of one paper layer, V | 400 | 400 |
| 7. | Dielectric loss tangent of dry paper at temperature, °C. | | |
| | 30 | 0.0010 | 0.0023 |
| | 60 | 0.0008 | 0.0019 |
| | 100 | 0.0010 | 0.0032 |
| | 120 | 0.00135 | 0.0068 |
| 8. | Resistivity of dry paper at 120°, Ohm . cm | $6.1 \cdot 10^{15}$ | $2.8 \cdot 10^{14}$ |
| 9. | Dielectric constant of dry paper | 2.7 | 3.1 |
| 10. | Dielectric loss tangent of the paper impregnated with trichlorodiphenyl (in small-size capacitors) at temperature, °C. | | |
| | 20 | 0.0021 | 0.0035 |
| | 60 | 0.0018 | 0.0032 |
| | 100 | 0.0018 | 0.0046 |
| | 120 | 0.0025 | 0.0081 |
| 11. | Boron content, weight % with respect to absolutely dry material | 0.45 | 0 |

EXAMPLE 7

Electric insulation paper on the basis of pure electric insulation cellulose obtained from tissue of conifers with the use of deionized water is prepared in the following way.

Paper pulp manufactured under industrial conditions with 0.23 weight % of cellulose and ground to 96° Schotter-Riegler is taken from a pressure box of a paper-making machine. 14 g of boric anhydride are added to 1000 ml of said paper pulp and the mixture is stirred for 3 minutes.

Boric anhydride introduced into the paper pulp reacts with water containing in the pulp according to the reaction:

$$B_2O_3 + 3H_2O \rightarrow 2H_3BO_3$$

From the paper pulp treated in the described way the samples of electric insulation paper are prepared on a laboratory paper-making machine by casting, pressing, and drying of paper sheets.

The paper obtained a thickness of 50μ, density 0.7 g/cm$^3$, and boron content 0.9 weight % with respect to absolutely dry material.

Control samples of electric insulation paper not containing boron are prepared by the same process but without introduction of boron anhydride and on the same equipment.

Tg δ is determined for the prepared samples by following the procedure described in example 1; its value are listed in Table 7.

TABLE 7

| Temperature, °C. | tan δ of the samples containing boron | tan δ of the samples control |
|---|---|---|
| 30 | 0.0005 | 0.00105 |
| 60 | 0.0004 | 0.0085 |
| 100 | 0.0004 | 0.00090 |
| 120 | 0.0004 | 0.0012 |

EXAMPLE 8

Samples of electric insulation paper containing 0.9 weight % of boron with respect to absolutely dry material and control samples without boron are prepared by following the procedure described in Example 7, as the boron compound use being made of metaboric acid.

Metaboric acid reacts with water contained in the paper pulp with the formation of boric acid according to the scheme:

$$HBO_2 + H_2O \rightarrow H_3BO_3$$

The tan δ values given in Table 8 are determined for the samples by following the procedure described in Example 1.

TABLE 8

| Temperature, °C. | tan δ of the samples containing boron | tan δ of the samples control |
|---|---|---|
| 30 | 0.0005 | 0.00105 |
| 60 | 0.0004 | 0.00085 |
| 100 | 0.0004 | 0.0009 |
| 120 | 0.0004 | 0.0012 |

EXAMPLE 9

Electric insulation paper is prepared under laboratory conditions on the basis of pure electric insulation cellulose obtained from tissue of conifers with the use of deionized water.

Paper pulp is prepared by breaking 20 g of electric insulation cellulose poured over with 1000 ml of deionized water in a laboratory stirrer for half an hour at 1000 rpm and by grinding the obtained suspension in a laboratory breaker for 12 hours to 95° Schotter-Riegler.

The paper pulp thus prepared is diluted with 1000 ml of deionized water after which paper sheet is obtained on a laboratory installation by casting and pressing.

Half amount of the paper sheet is treated with the aid of a pulverized by 10 ml of 0.1% aqueous solution of boric acid, said boric acid being applied evenly to the whole surface area of the paper sheet. After repeated pressing and drying, electric insulation paper is prepared with a thickness of 50 mkm, density 0.7 g/cm$^3$, and 0.04 weight % of boron with respect to absolutely dry material.

The remaining half of the paper sheet is dried and used for preparing control samples of electric insulation paper which does not contain boron and has the same thickness and density.

The values of tan δ given in Table 9 are determined for the samples of paper of both types by following the procedure described in Example 1.

TABLE 9

| Temperature, °C. | tan δ of samples containing boron | control |
|---|---|---|
| 30 | 0.0010 | 0.0011 |
| 60 | 0.0008 | 0.00085 |
| 100 | 0.0008 | 0.0009 |
| 120 | 0.0010 | 0.0012 |

EXAMPLE 10

The samples of electric insulation paper treated with boric acid and control samples of electric insulation paper not containing boron are prepared by following the procedure described in Example 9. The samples are 50 mkm thick and have a density of 0.7 g/cm$^3$.

The paper sheet is treated with 6% aqueous solution of boric acid to produce the samples of electric insulation paper. The samples obtained contain 0.91 weight % of boron with respect to absolutely dry material.

The values of tan δ given in Table 10 are determined for the samples of paper of both types.

TABLE 10

| Temperature, °C. | tan δ of the samples containing boron | control |
|---|---|---|
| 60 | 0.0004 | 0.00085 |
| 100 | 0.00035 | 0.0009 |
| 120 | 0.0004 | 0.0012 |

EXAMPLE 11

The samples of cable electric insulation paper are prepared under industrial conditions from pure electric insulation cellulose obtained from tissue of conifers with the use of deionized water. In the process of sample preparation the paper pulp is used also obtained with deionized water. The samples are 120 mkm thick and have a density of 0.80 g/cm$^3$.

The obtained samples are immersed for 5 seconds into 6% aqueous solution of boric acid and dried. The density of dried samples is 0.7 g/cm$^3$, boron content 1.1 weight % with respect to absolutely dry material.

The values of tan δ given in Table 11 have been determined for the samples of cable paper treated with boric acid according to the invention and for the samples of the initial cabel paper not containing boron. Tan δ is determined by following the procedure described in Example 1.

TABLE 11

| Temperature, °C. | tan δ of the samples containing boron | control |
|---|---|---|
| 60 | 0.0008 | 0.0018 |
| 100 | 0.0009 | 0.0025 |
| 120 | 0.0011 | 0.0049 |

EXAMPLE 12

Suspension containing 2.0 weight % of electric insulation cellulose is prepared under industrial conditions with the use of deionized water from pure electric insulation cellulose, said cellulose being obtained from the tissue of conifers also with the use of deionized water. After grinding the above-cited suspension to 96° Schotter-Riegler, two portions are withdrawn 150 g each. 100 ml of 0.08% aqueous suspension of active aluminium γ-oxide and 50 ml of 28% boric acid solution are successively added to one portion whereas to the other portion only 100 ml of 0.08% aqueous suspension of active aluminium γ-oxide are added.

The volume of each portion after adding the above-cited ingredients is brought to 1000 ml with deionized water, stirred for 5 minutes at 1000 rpm and the paper pulp thus obtained is used for preparing the samples of electric insulation paper with 0.55 weight % of boron by casting, pressing, and drying of paper sheets on a laboratory installation as well as for preparing control samples from paper not containing boron. The thickness of all the samples is 50μ, density 0.7 g/cm$^3$.

The values of tan δ given in Table 12 are determined for all samples by following the procedure described in Example 1.

TABLE 12

| Temperature, °C. | tan δ of the samples containing boron | control |
|---|---|---|
| 60 | 0.00045 | 0.0009 |
| 100 | 0.00040 | 0.0010 |
| 120 | 0.00045 | 0.00115 |

EXAMPLE 13

Electric insulation paper is prepared under laboratory conditions from pure electric insulation cellulose obtained from tissue of conifers with the use of deionized water.

Paper pulp is prepared by breaking 10 g of electric insulation cellulose poured over with 1000 ml of desalted water in a laboratory stirrer for half an hour at 1000 rpm and by grinding the obtained suspension in a laboratory breaker for 16 hours to 96° Schotter-Riegler. The paper pulp thus prepared is diluted with 3000 ml of desalted water then 75 g of triethylborate are added into the pulp and the mixture is stirred for 5 minutes.

Triethylborate reacts with water contained in the paper pulp giving boric acid according to the reaction:

$$(C_2H_5O)_3 + 3\ H_2O \rightarrow 3\ C_2H_5OH + H_3BO_3.$$

After this the paper pulp is used for preparing the samples of electric insulation paper with a density of 0.7 g/cm$^3$, thickness 50μ, and a boron content of 0.37 weight % with respect to absolutely dry material.

The control samples of electric insulation paper are prepared from the same material, on the same equipment, and by the same process. The control samples are of the same thickness and density as those containing boric acid.

The values of tan δ were determined for the samples of both types of the paper by following the procedure described in Example 1. The values obtained are presented in Table 13.

TABLE 13

| Temperature, °C. | tan δ of the samples containing boron | control |
|---|---|---|
| 30 | 0.00050 | 0.00105 |
| 60 | 0.00040 | 0.00085 |
| 100 | 0.00035 | 0.00090 |

EXAMPLE 14

Electric insulation paper based on pure electric insulation cellulose obtained from tissues of conifers with the use of deionized water is prepared in the following way.

Paper pulp prepared under industrial conditions, containing 0.23 weight % of cellulose, and grinding to 96° Schotter-Riegler is withdrawn from a pressure box of a paper-making machine. A mixture of boric acid and boric anhydrice in amounts 5 and 1.4 g, respectively is added upon stirring to 1000 ml of said paper pulp and stirring is continued for 3 minutes.

The above-cited boric anhydride, being introduced into the paper pulp, interacts with water contained in it with the formation of boric acid according to the scheme:

$$B_2O_3+3\ H_2O \rightarrow 2\ H_3BO_3.$$

The samples of electric insulation paper are prepared from the paper pulp treated in the above way on a laboratory paper-making machine by casting, pressing and drying paper sheet. The samples are 50μ/thick, has a density of 0.7 g/cm$^3$ and boron content 0.27 weight % with respect to absolutely dry material.

The control samples of electric insulation paper of the same thickness and density but not containing boron are obtained on the same equipment by the same process with the exception of the stage of boric acid and boron anhydride introduction.

The values of tan δ given in Table 14 are determined for the samples of said papers.

TABLE 14

| Temperature, °C. | tan δ of the samples containing boron | control |
|---|---|---|
| 30 | 0.00070 | 0.00105 |
| 60 | 0.00060 | 0.00085 |
| 100 | 0.00055 | 0.00090 |
| 120 | 0.00055 | 0.00120 |

EXAMPLE 15

The samples of electric insulation paper containing 0.45 weight % of boron with respect to absolutely dry material and control samples without boron are prepared by following the procedure described in Example 14 but with the use as the boron compound of a mixture of boric and metaboric acids in amounts 7.5 and 3.5 g, respectively.

Metaboric acid interacts with water contained in the paper pulp with the formation of boric acid according to the scheme:

$$HBO_2+H_2O \rightarrow H_3BO_3.$$

The values of tan δ presented in Table 15 are determined for all the papers by following the procedure described in Example 1.

TABLE 15

| Temperature, °C. | tan δ of the samples containing boron | control |
|---|---|---|
| 30 | 0.00050 | 0.00105 |
| 60 | 0.00040 | 0.00085 |
| 100 | 0.00040 | 0.00090 |
| 120 | 0.00040 | 0.0012 |

EXAMPLE 16

The samples of electric insulation paper containing 0.35 weight % of boron with respect to absolutely dry material and control samples not containing boron have been prepared by following the procedure described in Example 14 with the use as the boron compound of a mixture of boric acid and triethylborate in amounts 5 and 12 g, respectively.

Triethylborate reacts with water contained in the paper pulp with the formation of boric acid according to the scheme:

$$(C_2H_5O)_3B+3\ H_2O \rightarrow 3\ C_2H_5OH+H_3BO_3$$

The values of tan δ presented in Table 16 are determined for the samples of the paper of both types by following the procedure described in Example 1.

TABLE 16

| Temperature, °C. | tan δ of the samples containing boron | control |
|---|---|---|
| 30 | 0.00055 | 0.00105 |
| 60 | 0.00045 | 0.00085 |
| 100 | 0.00045 | 0.00090 |
| 120 | 0.00045 | 0.00120 |

EXAMPLE 17

Electric insulation paper is prepared under laboratory conditions by following the procedure described in Example 1 on the basis of pure electric insulation cellulose obtained from tissues of conifers with the use of desalted water.

Then the part of the samples is uniformly pulverized with 4% water-alcohol solution of boric acid (weight ratio water: alcohol is 6:4) in amount 0.5 g of solution per g of absolutely dry paper. Then the samples are dried. The boron content is 0.36 wt.% with respect to absolutely dry paper; density of the paper is 0.7 g/cm$^3$, thickness 50μ.

The values of tan δ presented in Table 17 are determined for treated and untreated samples by following the procedure described in Example 1.

TABLE 17

| Temperature, °C. | tan δ of the samples containing boron | control |
|---|---|---|
| 30 | 0.0006 | 0.00105 |
| 60 | 0.0005 | 0.00085 |
| 100 | 0.0005 | 0.0009 |
| 120 | 0.0005 | 0.0012 |

EXAMPLE 18

Electric insulation paper is prepared under laboratory conditions by following the procedure described in Example 1 on the basis of pure electric insulation cellulose obtained from tissue of conifers.

Then the part of the samples is treated with 3% water-alcohol solution of boric acid (weight ratio alcohol:-water is 14:1) in amount 1 ml of the solution per g of absolutely dry paper. The boron content in the paper is 0.54 weight % with respect to absolutely dry paper.

The values of tan δ listed in table 18 are determined for the samples of treated and untreated paper by following the procedure described in Example 1. The density of the paper is 0.7 g/cm$^3$, thickness 50$\mu$.

TABLE 18

| Temperature, °C. | tan δ of the samples containing boron | control |
|---|---|---|
| 30 | 0.0005 | 0.00105 |
| 60 | 0.0004 | 0.00085 |
| 100 | 0.0004 | 0.0009 |

TABLE 18-continued

| Temperature, °C. | tan δ of the samples containing boron | control |
|---|---|---|
| 120 | 0.0004 | 0.0012 |

What is claimed is:

1. A process for producing cellulose-based electric insulation paper, which comprises preparing a cellulose-based paper pulp, casting said paper pulp into a paper sheet, and pressing and drying said paper sheet, wherein at least one of said paper pulp or paper sheet is treated with a chemical reagent selected from the group consisting of boric acid, a boron compound forming boric acid when reacted with water, and a mixture thereof, said reagent being added in an amount such that the boron content in the desired paper is 0.02 to 1.1% by weight with respect to the absolutely dry paper.

2. A process as claimed in claim 1, wherein boric acid is used in the form of its aqueous solution.

3. A process as claimed in claim 1, wherein boric acid is used in the form of its water-alcohol solution.

4. A process as claimed in claim 1, wherein as the boron compound use is made of a compound selected from the group consisting of boric anhydride, metaboric acid, and triethyl borate.

5. A process as claimed in claim 4, wherein said boron compound is used in the form of its alcohol solution.

6. A process as claimed in claim 1, wherein said compounds used as the chemical reagent are introduced at the stage of paper pulp preparation.

7. A process as claimed in claim 1, wherein said compounds used as the chemical reagent are introduced before the pressing stage.

8. A process as claimed in claim 1, wherein said compounds used as the chemical reagent are introduced before the drying stage.

* * * * *